US009812814B1

(12) United States Patent
Borkar et al.

(10) Patent No.: US 9,812,814 B1
(45) Date of Patent: Nov. 7, 2017

(54) SAFETY LOCKOUT FEATURE FOR PLUG

(71) Applicant: Appleton Grp LLC, Rosemont, IL (US)

(72) Inventors: Tushar Borkar, Pune (IN); Abhinav S. Sachan, Pune (IN); Christopher R. Ruhland, Chicago, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/581,750

(22) Filed: Apr. 28, 2017

(30) Foreign Application Priority Data

Mar. 7, 2017 (IN) ..... IN201721007973

(51) Int. Cl.
*H01R 13/639* (2006.01)

(52) U.S. Cl.
CPC ..... *H01R 13/6397* (2013.01)

(58) Field of Classification Search
CPC ..... H01R 13/6397
USPC ..... 439/133
See application file for complete search history.

(56) References Cited

U.S. PATENT DOCUMENTS 1,662,275 A * 3/1928 Lane ..... H02G 3/123 174/53
4,679,873 A * 7/1987 Brackett, Jr. ..... H01R 13/6397 439/134
4,740,168 A * 4/1988 Carney ..... H01R 13/60 439/133
4,957,445 A * 9/1990 Burke, Jr. ..... H01R 13/60 439/133
5,097,103 A * 3/1992 Workman ..... H01R 13/6397 191/1 R
5,178,551 A * 1/1993 Bach ..... H01R 13/6397 439/133
5,186,636 A 2/1993 Boyer et al.
5,273,445 A * 12/1993 Ehrenfels ..... H01R 13/60 439/134
5,449,302 A 9/1995 Yarbrough et al.
(Continued)

FOREIGN PATENT DOCUMENTS

WO 2013/090781 6/2013

OTHER PUBLICATIONS

Pre-2017 Cooper Crouse-Hinds PowerMate brochure, pp. 2-15.
2012 Meltric Decontactors brochure, 28 pages.

*Primary Examiner* — Briggitte R Hammond
(74) *Attorney, Agent, or Firm* — McDonnell Boehnen Hulbert & Berghoff LLP

(57) ABSTRACT

An electrical plug is provided including a plug housing having a hollow interior surrounded by an outer wall, a first plurality of electrical connectors positioned within the hollow interior that are adapted to mate with a second plurality of electrical connectors positioned on a plug housing, a first aperture extending through the outer wall, a locking member extending from within the hollow interior through the first aperture in the outer wall, wherein the locking member includes a retainer that abuts a surface of the outer wall, wherein the locking member includes one a more holes positioned outside of an outer surface of the outer wall, a locking element secured through the one or more holes on the locking member, and wherein the locking member prevents the plug receptacle from being fully engaged with the plug housing.

22 Claims, 4 Drawing Sheets

(56) References Cited

U.S. PATENT DOCUMENTS

| | | | | | |
|---|---|---|---|---|---|
| 5,573,412 | A | * | 11/1996 | Anthony | H01R 13/6397 220/242 |
| 5,601,440 | A | | 2/1997 | Richter | |
| D386,149 | S | * | 11/1997 | Malone, Sr. | D13/156 |
| D391,469 | S | | 3/1998 | Foushee | |
| 7,101,201 | B1 | * | 9/2006 | McCollum | H01R 13/6397 439/133 |
| D682,660 | S | | 5/2013 | Aldrich et al. | |
| 8,979,559 | B2 | | 3/2015 | Aldrich et al. | |

* cited by examiner

SAFETY LOCKOUT FEATURE FOR PLUG

RELATED APPLICATIONS

This application claims priority to Indian Application Serial No. IN201721007973 entitled "Safety Lockout Feature for Plug," filed on Mar. 7, 2017.

FIELD

This patent application is directed generally to electrical plug assemblies that may be used to connect power for industrial equipment. More particularly, the patent application is directed to an electrical plug having a plug housing adapted to mate with an electrical plug receptacle, where the plug housing includes a lockout mechanism to prevent insertion of the plug housing into the plug receptacle when it is desired to prevent electrical contact between the electrical connectors in the plug receptacle and the plug housing.

BACKGROUND

Electrical plugs and electrical plug receptacles are used to connect a power source to energize electronic equipment, often in industrial applications. In such industrial applications, there are times when the equipment undergoes maintenance, service, or repair, in which case the power or electricity to the equipment needs to be disconnected. To disconnect the power or electricity from reaching the equipment, the electrical plug may be unplugged from the electrical plug receptacle to stop the power or electricity from reaching the electrical equipment being maintained, serviced, or repaired.

In industrial applications, often high voltage and/or high amperage is involved such that in the event that the electrical plug is inadvertently or accidently inserted into the electrical plug receptacle, a dangerous situation may result for the individuals involved in the maintenance, service, or repair of the electrical equipment. As a result, it would be desirable to provide a mechanism to prevent an electrical plug from being inserted into an electrical plug receptacle during such maintenance, service, or repair such that the electrical plug is "locked out" or prevented from coming into electrical engagement with the electrical plug receptacle.

SUMMARY

An electrical plug assembly is provided which advantageously provides for locking out an electrical plug from electrical engagement with an electrical plug receptacle when electronic equipment is undergoing maintenance, service, or repair. An electrical plug is provided with a plug housing having a hollow interior surrounded by an outer wall and a plurality of electrical connectors positioned within the hollow interior that are adapted to mate with a plurality of electrical connectors positioned on a plug receptacle. In order to provide the locking out functionality, an aperture extends through the outer wall of the plug housing, and a locking member extends from within the hollow interior of the plug housing through the aperture in the outer wall of the plug housing. To retain the locking member in place, the locking member includes a retainer that abuts either an inner surface of the outer wall of the electrical plug housing adjacent a first aperture in the outer wall, or abuts an outer surface of the outer wall of the electrical plug housing adjacent a second aperture in the outer wall. Further, the locking member includes one a more holes positioned outside of an outer surface of the outer wall of the plug housing where a locking element, such as a padlock, may be secured through the one or more holes on the locking member. The use of the locking member prevents the plug from being fully engaged with the plug receptacle, and prevents the plurality of electrical connectors on the electrical plug housing and the electrical plug receptacle from coming into electrical contact; thereby locking out the electrical plug from engagement with the electrical plug receptacle and preventing the energization of the electronic equipment during maintenance, service, or repair.

In one embodiment, an electrical plug is provided including a plug housing having a hollow interior surrounded at least partially by an outer wall, a first plurality of electrical connectors positioned within the hollow interior of the plug housing that are adapted to mate with a second plurality of electrical connectors positioned on a plug receptacle, a first aperture extending through the outer wall of the plug housing, a locking member positionable through the first aperture in the outer wall of the plug housing, wherein the locking member includes a retainer that abuts a surface of the outer wall of the plug housing when the locking member is extended through the aperture of the outer wall from within the hollow interior of the plug housing, wherein the locking member includes one or more holes adapted to receive a locking element or lockout tag, and wherein when the locking member is positioned through the first aperture in the outer wall of the plug housing and the locking element or lockout tag is secured through the one or more holes of the locking member, the plug receptacle cannot be fully engaged with the plug housing.

In another embodiment, an electrical plug is provided including a plug housing having a hollow interior surrounded at least partially by an outer wall, a first plurality of electrical connectors positioned within the hollow interior of the plug housing that are adapted to mate with a second plurality of electrical connectors positioned on a plug receptacle, a first aperture extending through the outer wall of the plug housing, a locking member extending from within the hollow interior of the plug housing through the first aperture in the outer wall of the plug housing, wherein the locking member includes a retainer that abuts a surface of the outer wall of the plug housing, wherein the locking member includes one or more holes positioned outside of an outer surface of the outer wall of the plug housing, a locking element secured through the one or more holes on the locking member, and wherein the locking member prevents the plug receptacle from being fully engaged with the plug housing.

BRIEF DESCRIPTION OF THE DRAWINGS

Exemplary embodiments are described herein with reference to the drawings wherein.

DETAILED DESCRIPTION

Figure 1:
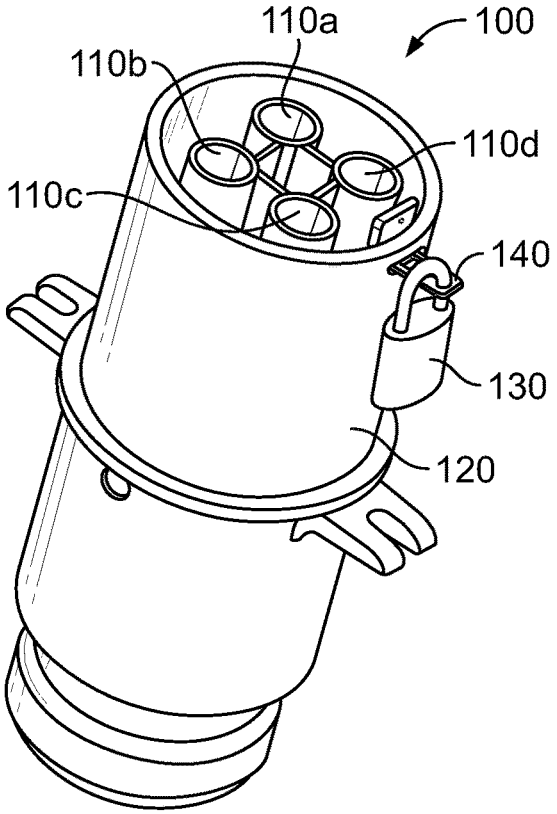
FIG. 1 is a perspective view of an electrical plug 100 with electrical connectors 110*a-d*, that is part of an electrical plug assembly.

FIG. 1 is a perspective view of an electrical plug 100 with electrical connectors 110*a-d* (one of which may be a ground pin). Electrical plug 100 is part of an electrical plug assembly that is adapted to electrically connect with an electrical plug receptacle to provide power or electricity to an electrically driven device, such as industrial equipment. When the electrical plug 100 is electrically engaged with an electrical plug receptacle (as shown in FIG. 6C), power or electricity is allowed to power the piece of industrial equipment. When the electrical plug 100 is electrically disengaged from the electrical plug receptacle, the power or electricity is no longer provided, allowing for the piece of industrial equipment to be maintained, serviced, or repaired.

Figure 6A:
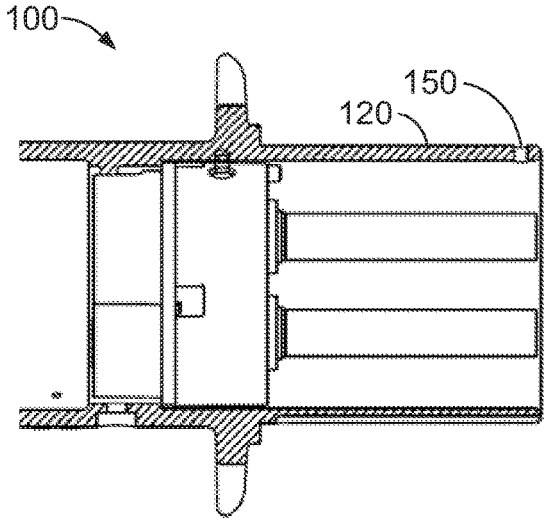
FIG. 6A is a cross-sectional view of electrical plug 100 shown in FIGS. 1 and 2.
Figure 6B:
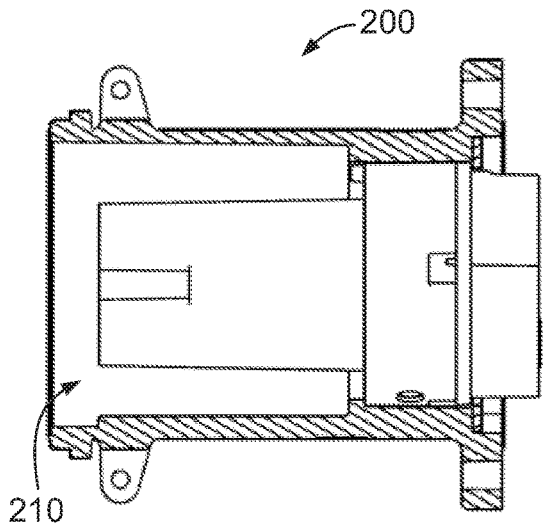
FIG. 6B is a cross-sectional view of electrical plug receptacle 200.
Figure 6C:
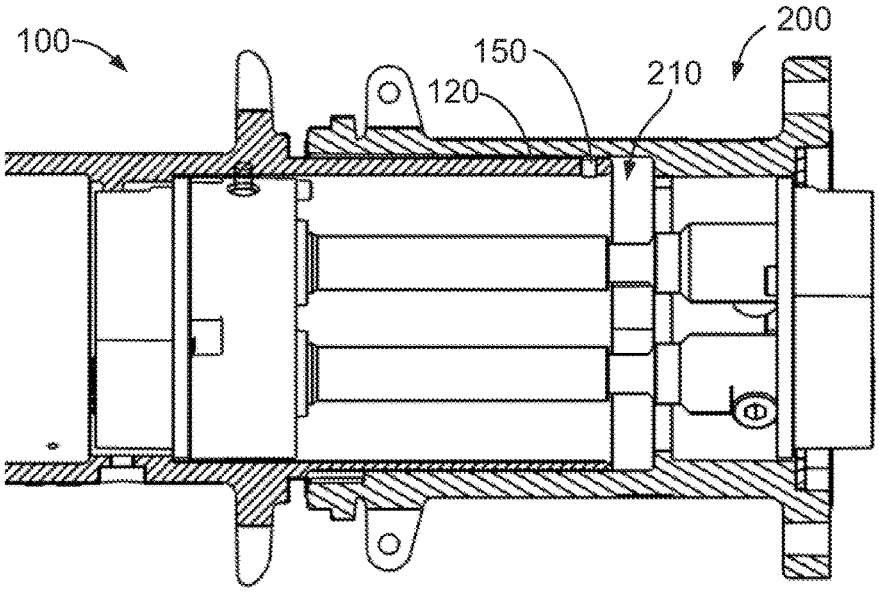
FIG. 6C is a cross-sectional view of electrical plug 100 engaged with electrical plug receptacle 200.

Once the electrical plug receptacle is electrically disengaged from the electrical plug 100 (as shown in FIGS. 6A and 6B, it is important that the electrical plug receptacle is unable to be inadvertently or accidentally electrically reengaged with electrical plug 100. As shown in FIG. 1, a locking member 140 extends outwardly from outer wall 120 of electrical plug 100. A locking element 130 (here shown as a padlock) is shown secured through a hole in the locking member 140 to provide a mechanism for locking out an electrical plug receptacle from engagement with the electrical plug 100. The locking element 130 prevents an electrical plug receptacle from inadvertently or accidentally reengaging with the electrical plug 100 during maintenance, service, or repair.

In FIG. 1, outer wall 120 is shown surrounding the electrical connectors 110*a-d* in a continuous fashion. However, the outer wall 120 could also partially surround the electrical connectors 110*a-d*, for example if one or more vertical slits were positioned in the outer wall 120 so that it was not continuous.

In FIG. 1, outer wall 120 is shown having circular inner and outer portions. However, in other embodiments the outer surface or inner surface of outer wall 120 could have a different geometry, such as oval, square, or hexagonal. In addition, in FIG. 1, the outer wall 120 is shown having a uniform wall thickness where both the inner and outer surfaces of outer wall 120 have a circular geometry. However, in other embodiments, the inner surface of the outer wall 120 could have a different geometry than the outer surface of the outer wall 120 such that outer wall 120 has a non-uniform wall thickness. For example, the outer surface of outer wall 120 could be circular or square and the inner surface of outer wall 120 could be hexagonal.

Figure 2:
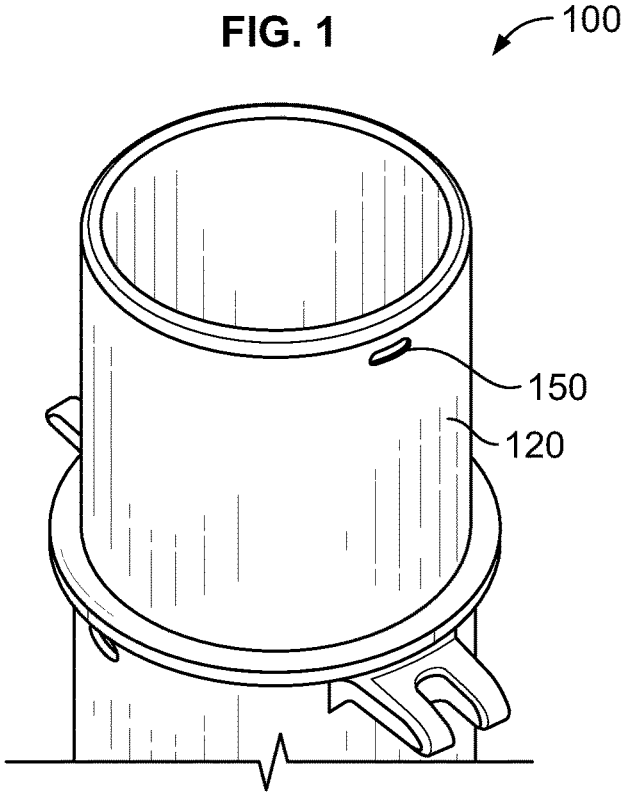
FIG. 2 is a perspective view of the electrical plug 100 shown in FIG. 1 with the electrical connectors 110*a-d* removed, and showing an aperture 150 in outer wall 120 of electrical plug 100.

FIG. 2 is a perspective view of the electrical plug 100 shown in FIG. 1 with the electrical connectors 110*a-d* removed, and showing an aperture 150 in outer wall 120 of electrical plug 100. The aperture 150 allows for the locking member 140 shown in FIG. 1 to extend therethrough to provide for a mechanism for locking out an electrical plug receptacle from electrically engaging with the electrical plug 100, while a piece of industrial equipment has been de-energized to allow for maintenance, service, or repair. In this embodiment, aperture 150 is shown as a horizontal slit. However, in other embodiments, different geometries could be used for aperture 150, such as a vertical or angled slit, circle, oval, hexagon, square, or other geometric shapes.

Figure 3:
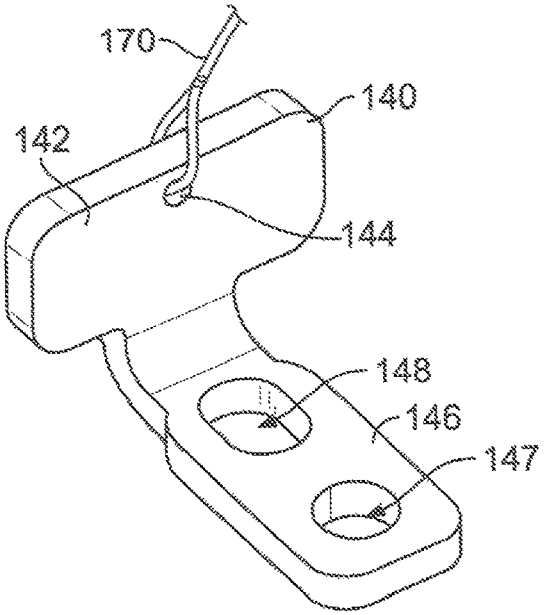
FIG. 3 is a perspective view of locking member 140 used in connection with electrical plug 100.

FIG. 3 is a perspective view of locking member 140 used in connection with electrical plug 100. In this embodiment, the locking member 140 is shown having a horizontal flange 146 that extends through aperture 150. A circular hole 147 and an oval hole 148 are positioned on horizontal flange 146 that may be used to allow a locking element, such as a padlock to "lock out" the electrical plug 100 to prevent an electrical plug receptacle from being inadvertently or accidentally electrically engaged with the electrical plug 100. Although in this embodiment the locking member 140 includes a horizontal flange 146, other geometries could be used as well. For example, the flange could have a round, oval, square, or rectangular cross-section, extend vertically or at an angle, or have other geometric configurations. In FIG. 3, locking member 140 includes a retainer 142 shown as an upwardly extending vertical flange that is attached to horizontal flange 146. Retainer 142 abuts an inner surface of outer wall 120 (shown in FIG. 4) when in use. In the embodiment of FIG. 3, retainer 142 is shown as an upwardly extending vertical flange. However, in other embodiments, retainer 142 could extend downwardly, to the side, or in a non-vertical manner. In addition, retainer 142 could also have other geometric configurations such as round, oval, square, etc.

In addition, retainer 140 includes a hole 144 extending therethrough to which a lanyard 170 could be attached. In this manner, the locking member 140 may remain attached to the electrical plug 100 via a lanyard 170 when it is not being used. As a result, when it comes time to "lock out" the electrical plug receptacle, the locking member 140 will be readily available.

Figure 4:
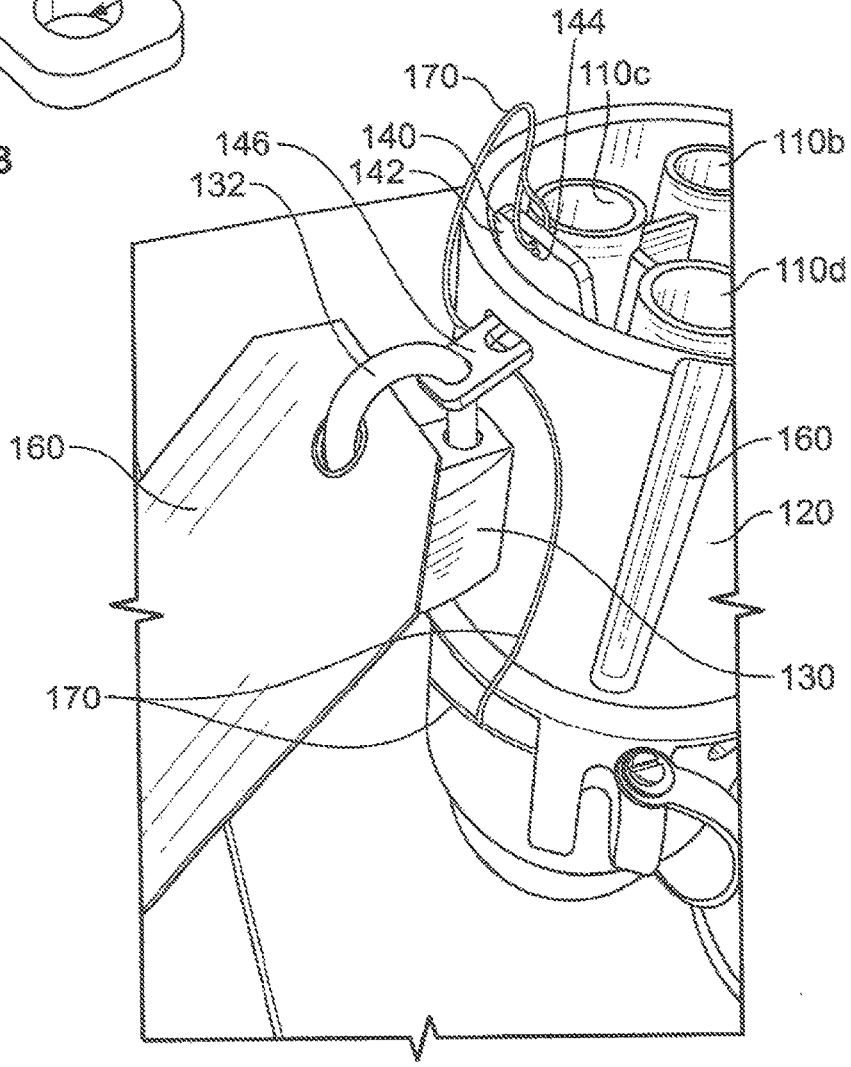
FIG. 4 is a close up perspective view of electrical plug 100 shown in FIG. 1, showing locking member 140 extending through outer wall 120 of electrical plug 100 with a locking element 130 secured to locking member 140 to lock out a plug receptacle from engagement with the electrical connectors 110*a-d* of electrical plug 100.

FIG. 4 is a close up perspective view of electrical plug 100 shown in FIG. 1, showing locking member 140 extending through outer wall 120 of electrical plug 100 with a locking element 130 secured to locking member 140 to lock out an electrical plug receptacle from engagement with the electrical connectors 110*a-d* of electrical plug 100. A vertical slot 160 is also shown which is used to align an electrical plug receptacle in an appropriate orientation. In FIG. 4, retainer 142 of locking member 140 can be seen abutting an inner surface of outer wall 120 to prevent the locking member 140 from exiting the outer wall 120. Horizontal flange 142 is shown extending through the aperture in outer wall 120 and locking member 130 (in this case a padlock) is secured through a hole in the horizontal flange. In particular, padlock arm 132 of padlock 130 extends through a hole in horizontal flange 146. In addition, a tag 160 is secured to padlock arm 132 of padlock 130 that may provide information explaining that the electrical plug is locked out, who is authorized to unlock, and where the key to unlock may be located.

In the configuration shown in FIG. 4, the electrical plug 100 is locked out, meaning that the locking member 140 serves to prevent an electrical plug receptacle from being inadvertently or accidentally electrically engaged with the electrical plug. A number of styles of plug assemblies may exist. For example, a plug housing can be used for style 1, style 2, or style 1 & 2. The position of the lockout slot 150 relative to the polarizing slot (vertical slot feature 160) may change for different plug styles. Preferably, the location of the lockout slot 150 is positioned further away from the ground pin (one of electrical connectors 110*a-d*) than any of the reminder of the plurality of pins (electrical connectors 110*a-d*).

Figure 5:
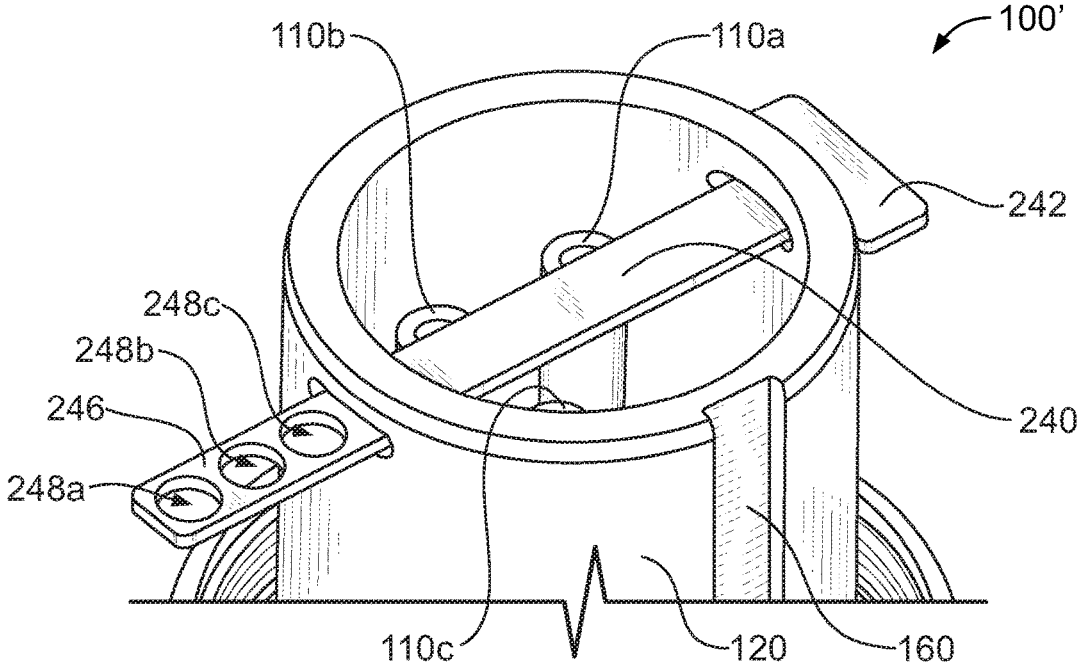
FIG. 5 is a perspective view of electrical plug 100' with locking member 240.

FIG. 5 is a perspective view of electrical plug 100' with locking member 240. In FIG. 5, the electrical plug 100' and locking member 240 are slightly different than locking element 140 shown in FIGS. 1-4. In particular, electrical plug 100' includes two apertures in the outer wall, through which locking member 240 extends. Electrical plug 100' operates in a similar fashion to electrical plug 100 to lock out an electrical plug receptacle from engaging the electrical connectors 110*a-c* shown in FIG. 5. In the embodiment of FIG. 5, locking member 240 extends through opposite sides of outer wall 120 and extends over the electrical connectors 110*a-c* and horizontal flange 246 extends outwardly from an outer surface of outer wall 120. Horizontal flange 246 includes a plurality of holes 248*a-c* through which a locking element, such as a padlock, may be secured to. Locking member 240 includes a retainer 242 that abuts an outer surface of outer wall 120 to secure the locking member in place with electrical plug 100'.

As with the locking member 140 shown in FIGS. 1-4, locking member 240 is shown as a horizontal flange. However, locking member 240 could also be oriented vertically or at an angle. In addition, locking member 240 could also have other geometric cross-sectional configurations such as round, oval, square, hexagonal, etc.

FIG. 6A is a cross-sectional view of electrical plug 100 having outer wall 120 and aperture 150 disengaged from the electrical plug receptacle 200 shown in FIG. 6B. When engaged, electrical plug 100 may be inserted into cavity 210 of electrical receptacle 200.

FIG. 6C is a cross-sectional view of electrical plug 100 engaged with electrical plug receptacle 200. In this view, the locking member has been removed from aperture 150 and the outer wall 120 of electrical plug 100 is shown inserted into cavity 210 of electrical plug receptacle 200 to provide for an electrical engagement.

Example embodiments of the present invention have been described above. Those skilled in the art will understand that changes and modifications may be made to the described embodiments without departing from the true scope of the present invention, which is defined by the claims.

We claim:

1. An electrical plug lockout assembly comprising:

a plug housing having a hollow interior surrounded at least partially by a longitudinally extending outer wall;

a first plurality of electrical connectors positioned within the hollow interior of the plug housing that are adapted to mate with a second plurality of electrical connectors positioned on an electrical plug;

a first aperture extending through the longitudinally extending outer wall of the plug housing;

a locking member positionable through the first aperture in the longitudinally extending outer wall of the plug housing;

wherein the locking member includes a retainer that abuts an inner surface of the longitudinally extending outer wall of the plug housing adjacent the first aperture when the locking member is extended through the aperture of the longitudinally outer wall from within the hollow interior of the plug housing;

wherein the locking member includes one or more holes adapted to receive a locking element or lockout tag; and wherein when the locking member is positioned through the first aperture in the longitudinally extending outer wall of the plug housing and the locking element or lockout tag is secured through the one or more holes of the locking member, the electrical plug cannot be fully engaged with the plug housing.

2. The electrical plug lockout assembly of claim 1, wherein when the locking member is positioned through the first aperture in the longitudinally extending outer wall of the plug housing and the locking element or lockout tag is secured through the one or more holes of the locking member, the first plurality of electrical connectors positioned within the interior of the plug housing are prevented from contacting the second plurality of electrical connectors on the electrical plug.

3. The electrical plug lockout assembly of claim 1, wherein an outer surface of the longitudinally extending outer wall of the plug housing has a circular cross-section.

4. The electrical plug lockout assembly of claim 3, wherein the inner surface of the longitudinally extending outer wall has a circular cross-section.

5. The electrical plug lockout assembly of claim 1, wherein the first aperture in the longitudinally extending outer wall comprises a horizontal slit.

6. The electrical plug lockout assembly of claim 1, wherein the locking member comprises a horizontal flange.

7. The electrical plug lockout assembly of claim 6, wherein the retainer comprises a vertical flange.

8. The electrical plug lockout assembly of claim 7, wherein the vertical flange extends upwardly from the horizontal flange and is adapted for engagement with the inner surface of the longitudinally extending outer wall of the plug housing adjacent the first aperture.

9. The electrical plug lockout assembly of claim 6, wherein the one or more holes extend vertically through the horizontal flange.

10. The electrical plug lockout assembly of claim 7, wherein an opening is positioned in the vertical flange adapted for attachment to a lanyard.

11. The electrical plug lockout assembly of claim 1, wherein the locking element comprises a padlock.

12. An electrical plug lockout assembly comprising:

a plug housing having a hollow interior surrounded at least partially by a longitudinally extending outer wall;

a first plurality of electrical connectors positioned within the hollow interior of the plug housing that are adapted to mate with a second plurality of electrical connectors positioned on an electrical plug;

a first aperture extending through the longitudinally extending outer wall of the plug housing;

a locking member extending from within the hollow interior of the plug housing through the first aperture in the longitudinally extending outer wall of the plug housing;

wherein the locking member includes a retainer that abuts an inner surface of the longitudinally extending outer wall of the plug housing adjacent the first aperture;

wherein the locking member includes one or more holes positioned outside of an outer surface of the longitudinally extending outer wall of the plug housing;

a locking element secured through the one or more holes on the locking member; and wherein the locking member prevents the electrical plug from being fully engaged with the plug housing.

13. The electrical plug lockout assembly of claim 12, wherein the first plurality of electrical connectors positioned within the interior of the plug housing are prevented from contacting the second plurality of electrical connectors on the electrical plug.

14. The electrical plug lockout assembly of claim 12, wherein an outer surface of the longitudinally extending outer wall of the plug housing has a circular cross-section.

15. The electrical plug lockout assembly of claim 14, wherein the inner surface of the longitudinally extending outer wall of the plug housing has a circular shape.

16. The electrical plug lockout assembly of claim 12, wherein the first aperture in the longitudinally extending outer wall of the plug housing comprises a horizontal slit.

17. The electrical plug lockout assembly of claim 16, wherein the locking member comprises a horizontal flange.

18. The electrical plug lockout assembly of claim 12, wherein the retainer comprises a vertical flange.

19. The electrical plug lockout assembly of claim 18, wherein the vertical flange extends upwardly from the horizontal flange and engages the inner surface of the longitudinally extending outer wall of the plug housing adjacent the first aperture.

20. The electrical plug lockout assembly of claim 18, wherein a lanyard is attached to an opening positioned in the vertical flange that is used to secure the locking member to the plug housing when it is not positioned through the first aperture in the outer wall of the plug housing.

21. The electrical plug lockout assembly of claim 12, wherein the locking element comprises a padlock.

22. The electrical plug lockout assembly of claim 19, wherein an upper end of the vertical flange of the retainer extends longitudinally beyond an outer end of the longitudinally extending outer wall.

* * * * *